US008297442B1

(12) United States Patent
Byron

(10) Patent No.: US 8,297,442 B1
(45) Date of Patent: Oct. 30, 2012

(54) LIGHT-WEIGHT BEVERAGE CRATE

(76) Inventor: Kent Byron, Lafayette, LA (US)

( * ) Notice: Subject to any disclaimer, the term of this patent is extended or adjusted under 35 U.S.C. 154(b) by 239 days.

(21) Appl. No.: 12/797,894

(22) Filed: Jun. 10, 2010

Related U.S. Application Data

(60) Provisional application No. 61/185,741, filed on Jun. 10, 2009.

(51) Int. Cl.
*B65D 21/00* (2006.01)
*B65D 90/02* (2006.01)

(52) U.S. Cl. ..... 206/503; 206/512; 220/607; 220/675

(58) Field of Classification Search ..... 220/607, 220/675; 206/503, 511, 512
See application file for complete search history.

(56) References Cited

U.S. PATENT DOCUMENTS

| | | | | | |
|---|---|---|---|---|---|
| 3,353,659 | A | | 11/1967 | Beesley et al. | |
| 3,809,279 | A | * | 5/1974 | Arjas | 220/516 |
| D265,009 | S | * | 6/1982 | Box | D3/314 |
| D273,338 | S | | 4/1984 | Walton | |
| 4,548,320 | A | | 10/1985 | Box | |
| D284,898 | S | | 7/1986 | Graham | |
| 4,901,876 | A | | 2/1990 | Box | |
| D307,499 | S | | 4/1990 | Box | |
| 4,971,202 | A | * | 11/1990 | Box | 206/511 |
| D338,312 | S | * | 8/1993 | Licari | D3/314 |
| 5,339,979 | A | | 8/1994 | Box | |
| 5,460,292 | A | * | 10/1995 | Holman | 220/675 |
| 5,465,901 | A | | 11/1995 | Paine, Jr. | |
| D549,455 | S | | 8/2007 | Kent et al. | |
| D569,619 | S | | 5/2008 | Kent et al. | |
| D614,403 | S | * | 4/2010 | Byron | D3/304 |
| 7,699,184 | B2 | * | 4/2010 | Meissen | 220/23.4 |

* cited by examiner

*Primary Examiner* — Mickey Yu
*Assistant Examiner* — Niki Eloshway
(74) *Attorney, Agent, or Firm* — Jones Walker

(57) ABSTRACT

A light-weight stackable beverage crate includes a bottom plate, four side walls forming an interior space for placement of objects, and four vertically extending columns interconnecting the side walls and bottom plate. Each side wall includes a pattern of outer and inner arches interconnected by lateral beams, vertical support beams, and cross-beams. Side walls may include handle recesses. A lateral beam defines an upper edge of the side wall and another lateral beam defines a lower edge of the side wall. An upper end of the column extends above the upper edge of the side walls, and a lower end of the column extends below the lower edge of the side walls. The upper and lower ends of the column are capable of distributing a load force. When stacked, the only load-bearing points of contact between crates above are the upper and lower ends of the columns.

1 Claim, 7 Drawing Sheets

LIGHT-WEIGHT BEVERAGE CRATE

CROSS-REFERENCE TO RELATED APPLICATION

This application claims the benefit of and priority to U.S. Provisional Patent Application No. 61/185,741, filed Jun. 10, 2009.

FIELD OF THE INVENTION

The present invention relates to a light-weight beverage crate and more particularly to a light-weight beverage crate having side walls with arch-shaped supporting members and load-bearing pads.

BACKGROUND OF THE INVENTION

Plastic molded crates have been used to transport beverages such as milk containers. Standard crates weigh between 2½ lbs. to 3 lbs. The crate carries a load of about 40-45 lbs. Crates are usually stacked forming a column of about six to eight crates. Accordingly, the load of a stacked column of crates may exceed 384 lbs.

U.S. Pat. No. 3,353,659 (which is incorporated herein by reference) describes a plastic tote case that may carry milk containers. The case includes cut-out areas in the side walls to provide for visibility of the identification of the case contents. The cut-outs are said to reduce the overall weight of the case.

U.S. Pat. No. 4,548,320 (which is incorporated herein by reference) describes a heavy-duty plastic beverage case. The case includes centrally disposed bearing pads on the upper edge of the end walls. The bearing pads are said to contribute to the structural strength of the case by transmitting compressive forces from the upper stacking rim to the bottom of the case.

The need still exists for a lighter-weight plastic molded beverage crate that is easier to manipulate, durable and structurally capable of bearing load forces.

SUMMARY OF THE INVENTION

It is an object of the present invention to provide a light-weight plastic molded beverage crate.

It is an object of the present invention to provide a stackable light-weight plastic molded beverage crate structurally capable of bearing load forces.

The objects and advantages of the present invention are achieved by the novel plastic molded beverage crate described herein. A stackable crate of the present invention may include a bottom plate, four side walls adjacent to the bottom plate forming an interior space for placement of objects, and four vertically extending columns interconnecting the side walls and bottom plate. Each side wall may include a pattern of outer arches and inner arches interconnected by a plurality of lateral beams, a plurality of vertical support beams, and a plurality of cross-beams. One lateral beam may define an upper edge of the side wall, and another lateral beam may define a lower edge of the side wall. Each column may have an upper end that extends above the upper edge of the side walls and a lower end that extends below the lower edge of the side walls. The upper and lower ends of the column may be capable of distributing a load force.

A portion of the bottom plate may extend below the lower edge of the side walls and below the lower end of the columns. The bottom plate may have a concave portion. The upper end of each column may include an upper load pad disposed above the upper edge of the side walls. The lower end of each column may include a lower load pad disposed below the lower edge of the side walls. Each side wall may include a handle recess for placement of a hand.

Each of the inner and outer arches may include two sides extending downward from an apex to two bottom points. Each inner arch may be concentrically disposed within an outer arch. Each side wall may have an upper central vertical beam, a lower central vertical beam, and two or more lateral rows of outer and inner arches. The upper central vertical beam may extend from the upper edge to a top edge of the handle recess. The lower central vertical beam may extend from a bottom edge of the handle recess to the lower edge of the side wall. Each cross-beam may interconnect the outer arches in each lateral row with other outer arches, upper or lower central vertical beams, a column adjacent to the side wall, or the lateral beams. One lateral beam may define a top of each lateral row and another lateral beam may define a bottom of each lateral row. Another lateral beam may extend through each lateral row interconnecting with the bottom points of the inner arches in the lateral row. Each vertical support beam may interconnect one or more of the lateral beams, the apex of an outer arch, and the apex of an inner arch. The crate may be formed of a light-weight plastic.

The present invention is also directed to a light-weight stackable beverage crate capable of bearing load forces. The crate may include a bottom plate, four side walls adjacent the bottom plate forming an interior space for placement of objects, four vertically extending columns interconnecting the side walls and bottom plate, four upper load pads, and four lower load pads. Each side wall may include a pattern of outer arches and inner arches interconnected by a plurality of lateral beams, a plurality of vertical support beams, and a plurality of cross-beams. A lateral beam may define an upper edge of the side wall. Another lateral edge may define a lower edge of the side wall. Each inner arch may be concentrically disposed within an outer arch. Each column may include an upper end and a lower end. Each upper pad may be operatively associated with the upper end of a column. The upper load pads may extend above the upper edge of the side walls. Each lower load pad may be operatively associated with the lower end of a column. The lower load pads may extend below the lower end of the side walls.

A portion of the bottom plate may extend below the lower edge of the side walls and below the lower load pads. Each side wall may include a handle recess for placement of a hand. The crate may weigh 1.5 to 2.0 pounds. The crate may be capable of supporting a load of 380 pounds in a stacked configuration.

The present invention is also directed to a method of stacking beverage crates. A first and a second crate may each include a bottom plate, four side walls adjacent to the bottom plate forming an interior space for placement of objects, and four vertically extending columns interconnecting the side walls and bottom plate. Each side wall may include a pattern of outer arches and inner arches interconnected by a plurality of lateral beams, a plurality of vertical support beams, and a plurality of cross-beams. A lateral beam may define an upper edge of the side wall, and another lateral beam may define a lower edge of the side wall. Each column may have an upper end that extends above the upper edge of the side walls, and a lower end that that extends below the lower edge of the side walls. A first load may be placed in the first crate's interior space, and a second load may be placed in the second crate's interior space. The first crate may be positioned on a bottom surface such that the bottom plate of the first crate contacts the bottom surface. The second crate may be stacked on top of the first crate such that the only load-bearing points of contact between the first and second crates are at the upper ends of the first crate's columns and the lower ends of the second crate's columns.

The method may further include transferring a weight of the second load through the first crate's columns to the first crate's bottom plate. A lower extending portion of the first and second crate's bottom plate may extend below the lower end of the first and second crate's columns, respectively. When stacked, the lower extending portion of the second crate's bottom plate may extend below the upper edge of the first crate's side wall within the first crate's interior space. A portion of the bottom plate of each crate may be concave. The upper end of each column of both crates may include an upper load pad disposed above the upper edge of the side walls. The lower end of each column of both crates may include a lower pad disposed below the lower edge of the side walls. The only load-bearing points of contact between the first and second crates may be the first crate's upper load pads and the second crate's lower load pads.

DETAILED DESCRIPTION OF THE PREFERRED EMBODIMENTS

Figure 1:
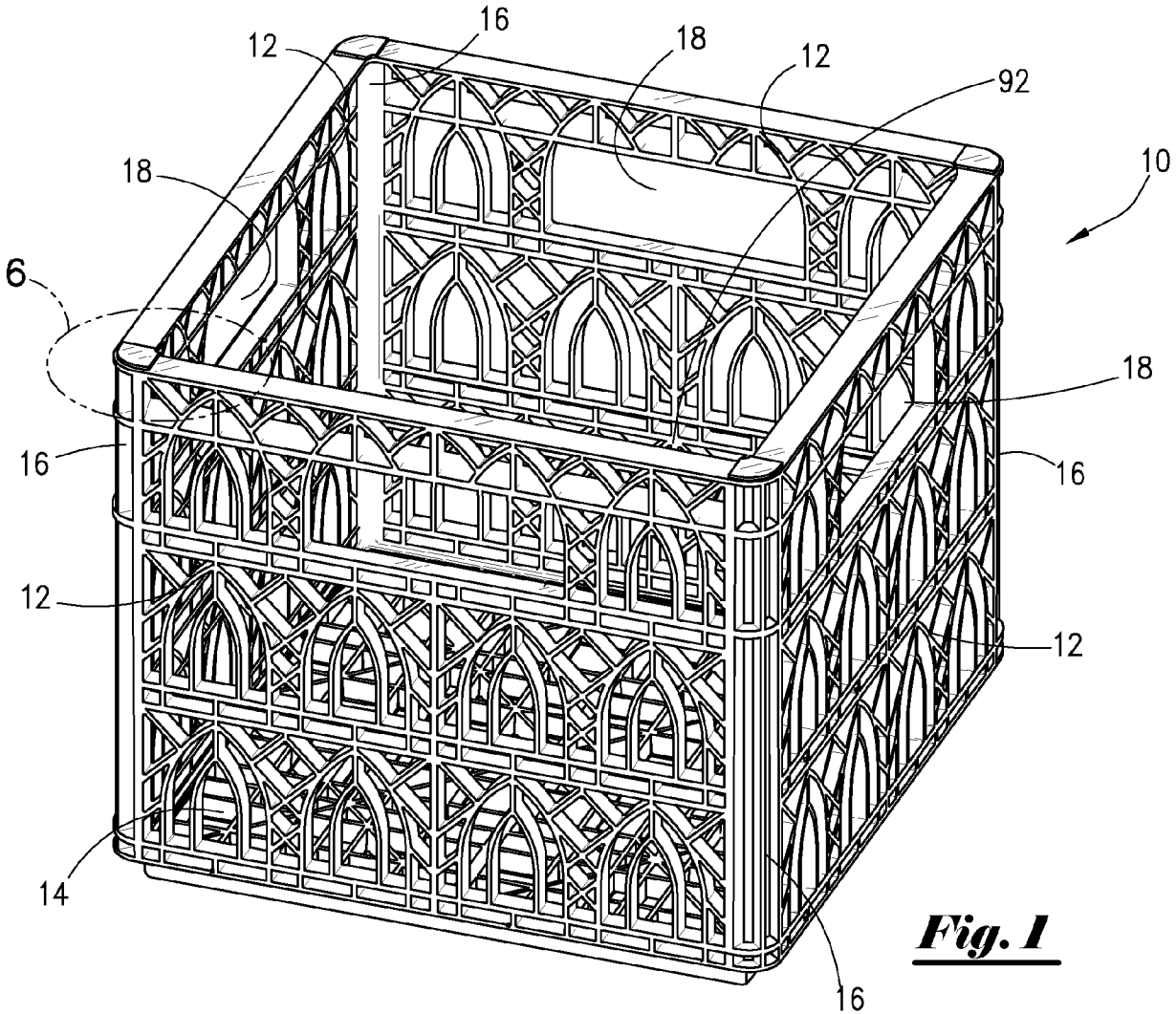
FIG. 1 is an isometric view of the crate of the present invention.

FIG. 1 shows crate 10. Crate 10 may be made formed as an integrally molded single piece by heat-injected plastic molding. Crate 10 may be molded from a plastic material such as a high density polyethylene or other plastic material having similar qualities. Crate 10 has a substantially square configuration with side walls 12 and bottom plate 14. Vertical columns 16 are positioned in each corner of crate 10. Columns 16 interconnect sidewalls 12 and bottom plate 14. Openings 18 are provided in side walls 12 and accommodate the hand of a person gripping crate 10 as may be done when crate 10 is physically moved by a person.

Figure 2:
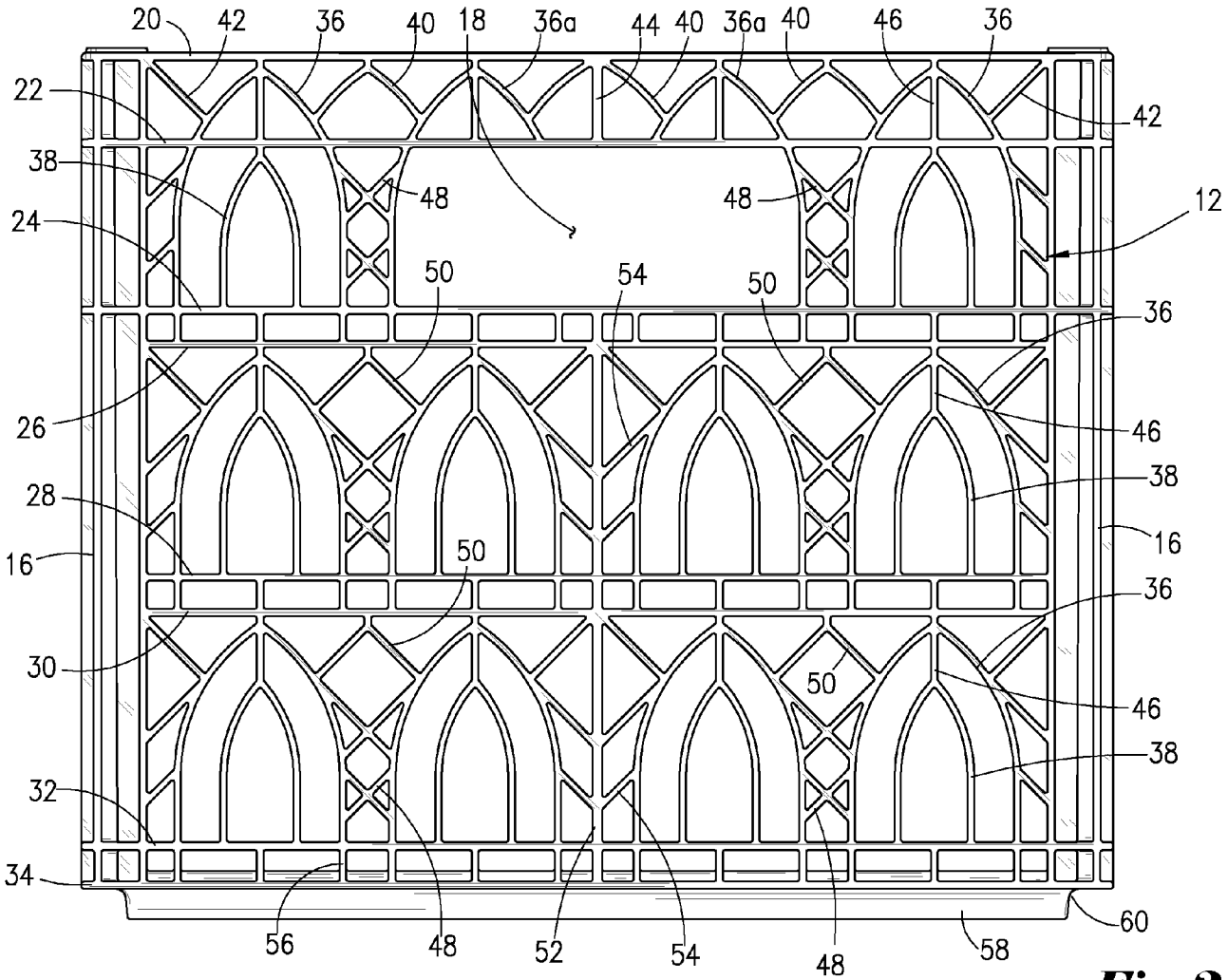
FIG. 2 is side view of the crate of the present invention.

With reference to FIG. 2, each side wall 12 includes a series of lateral supporting beams 20, 22, 24, 26, 28, 30, 32, and 34. Lateral beams 20 serve as an upper rim for crate 10. Interconnected between lateral beams 20, 22, 24 and 26 are a series of outer arches 36 and partial outer arches 36*a*. FIG. 2 shows two outer arches 36 and two partial outer arches 36*a* although less than two or more than two outer arches 36 and partial outer arches 36*a* may be used. Interconnected between lateral beams 22 and 24 are a series of inner arches 38 positioned with outer arches 36. FIG. 2 shows two inner arches 38 although less than or more than two inner arches 38 may be used. Cross-arches 40 interconnect lateral beam 20 and outer arches 36 and interconnect lateral beam 20 and partial outer arches 36*a*. Cross-beams 42 interconnect columns 16 to outer arches 36. Vertical support beam 44 is centrally positioned and interconnects lateral beam 20 and lateral beam 22. Vertical support beams 46 interconnect lateral beam 20, outer arches 36, lateral beam 22, and inner arches 36*a*. Vertical support beams 46 also interconnect lateral beam 20, partial outer arches 36*a* and lateral beam 22. Cross-beams 48 interconnect outer arches 36 and partial outer arches 36*a*.

Again with reference to FIG. 2, interconnected between lateral beams 24, 26, 28 and 30 are a series of outer arches 36. FIG. 2 shows four outer arches 36 although less than four or more than two outer arches 36 may be used. Inner arches 38 are positioned within and are interconnected to respective outer arches 36. FIG. 2 shows four inner arches 38 although less than or more than four inner arches 38 may be used. Cross-beams 42 interconnect columns 16 to outer arches 36. Central support beam 52 is centrally positioned and interconnects lateral beams 24, 26, 28, 30, 32, and 34. Vertical support beams 46 interconnect lateral beams 24 and 26, outer arches 36, and inner arches 36*a*. Cross-beams 48 interconnect outer arches 36. Cross-beams 50 interconnect lateral beam 26 and outer arches 36. Cross-beams 54 interconnect central support beam 52 and outer arches 36.

FIG. 2 also illustrates that interconnected between lateral beams 28, 30, 32 and 34 are a series of outer arches 36. FIG. 2 shows four outer arches 36 although less than or more than four outer arches may be used. Inner arches 38 are positioned within and are interconnected to respective outer arches 36. FIG. 2 shows four inner arches 38 although less than or more than four inner arches may be used. Cross-beams 42 interconnect columns 16 to outer arches 36. Vertical support beams 46 interconnect lateral beams 28 and 30, outer arches 36, and inner arches 36*a*. Cross-beams 48 interconnect outer arches 36. Cross-beams 50 interconnect lateral beam 30 and outer arches 36. Cross-beams 54 interconnect central support beam 52 and outer arches 36. Vertical braces 56 interconnect lateral beam 32 and lateral beam 34. Bottom lip 58 is positioned outwardly from lateral beam 34 and extends around the entirety of crate 10. Bottom lip 58 serves as a mating guide and accommodates the upper rim of another crate when crate 10 is stacked on top of another crate. In stacking arrangement, the upper rim (e.g., lateral beams 20) of the lower crate would be situated within receiving area 60 of crate 10.

Figure 3:
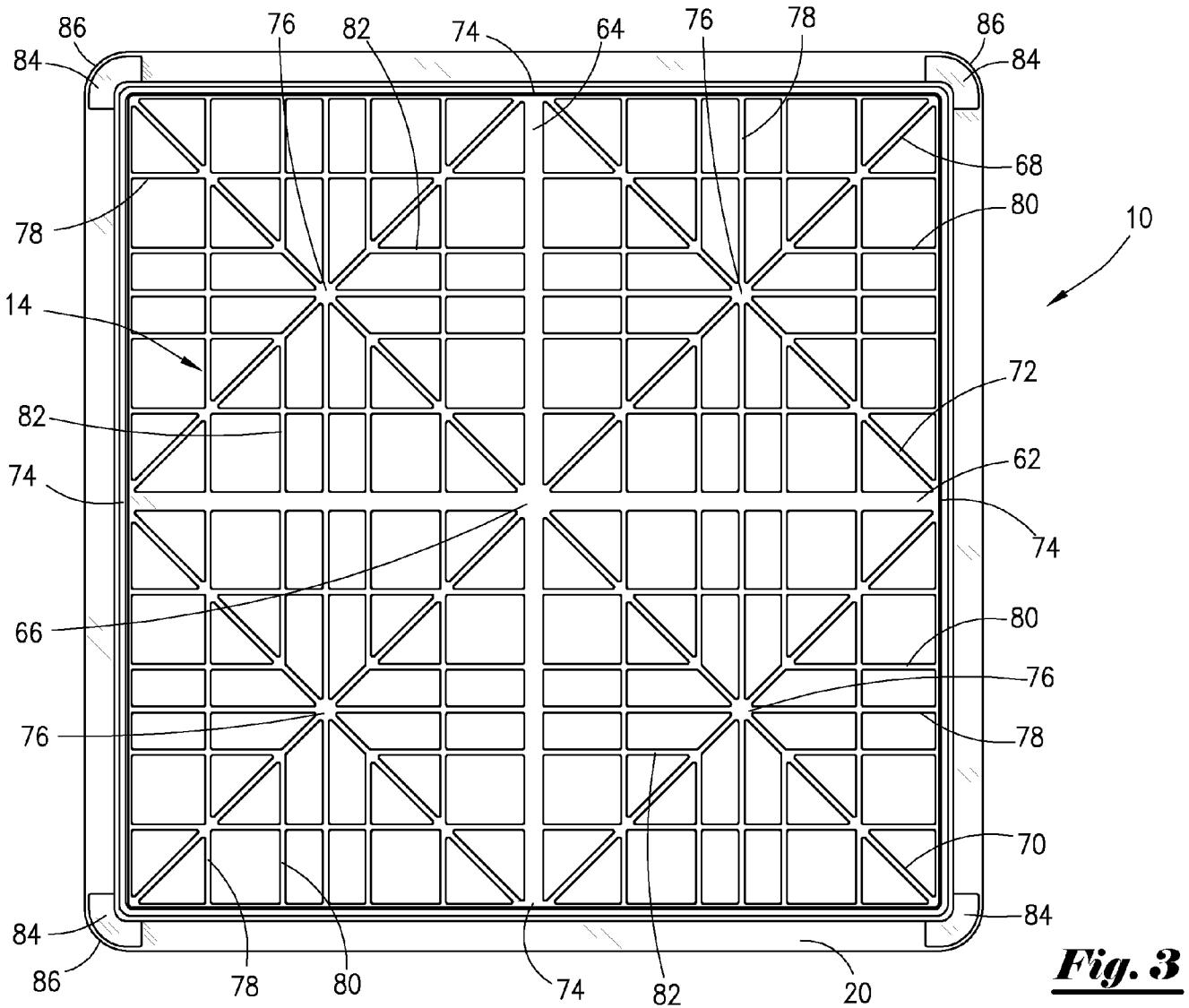
FIG. 3 is a top view of the crate of the present invention.
Figure 4:
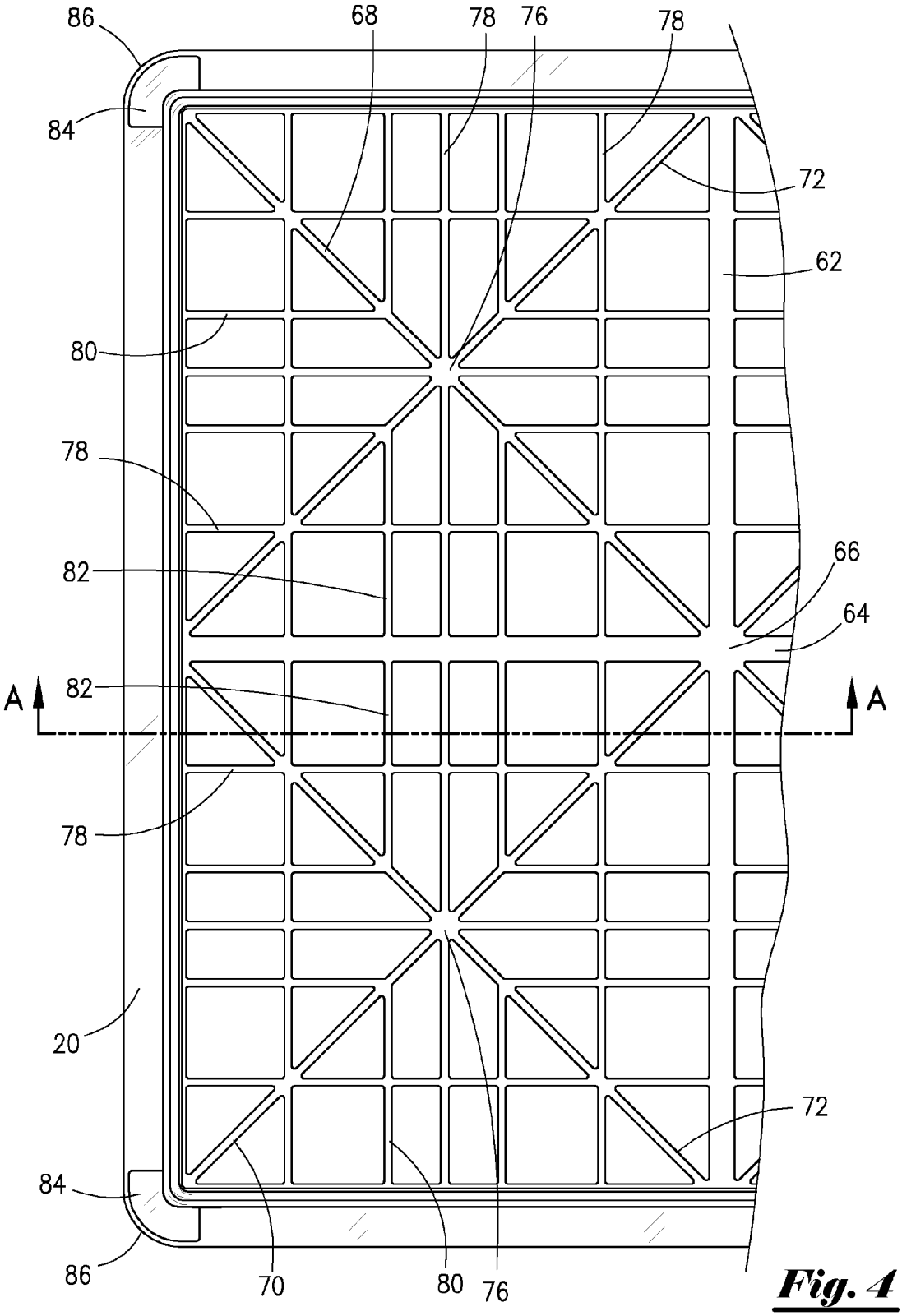
FIG. 4 is a partial top view of the crate of the present invention.

FIGS. 3 and 4 show the configuration of bottom plate 14. Bottom plate 14 includes central support beam 62 and central support beam 64 that interconnect opposing lateral beams 34 and intersect at central portion 66. Primary cross-beams 68, 70 each traverse bottom plate 14 from column 16 to opposing column 16 and interconnect at central portion 66 of central support beams 62, 64. Secondary cross-beams 72 traverse between distal ends 74 of central supports beams 62, 64 where they interconnect with central support beams 62, 64. Secondary cross-beams 72 intersect with primary cross-beams 68, 70 at point 76. Lateral beams 78 extend from opposite sides of bottom plate 14 and interconnect with central support beams 62, 64, primary cross-beams 68, 70 and secondary cross-beams 72. Lateral supports 80 interconnect lateral beam 34, at least one lateral beam 78, and primary cross-beams 68 or 70. Lateral supports 82 interconnect central support beams 62, 64, at least one lateral beam 78 and primary cross-beams 68 or 70.

FIGS. 3 and 4 also show upper load pads 84 positioned and affixed to columns 16 at corners 86 of crate 10. Upper loads pads 84 receive loads forces when in stacked arrangement with other crates and distribute such forces through columns 16 (to bottom plate 14) and away from the central portions of side walls 12 of crate 10, particularly the immediate areas adjacent to opening 18 in the handle portion of crate 10. By distributing the load forces away from the handle area, crate 10 achieves optimal structural integrity and is capable of withstanding forces well in excess of forces customarily generated when crates are stacked eight high, housing contents such as milk containers.

Figure 5:
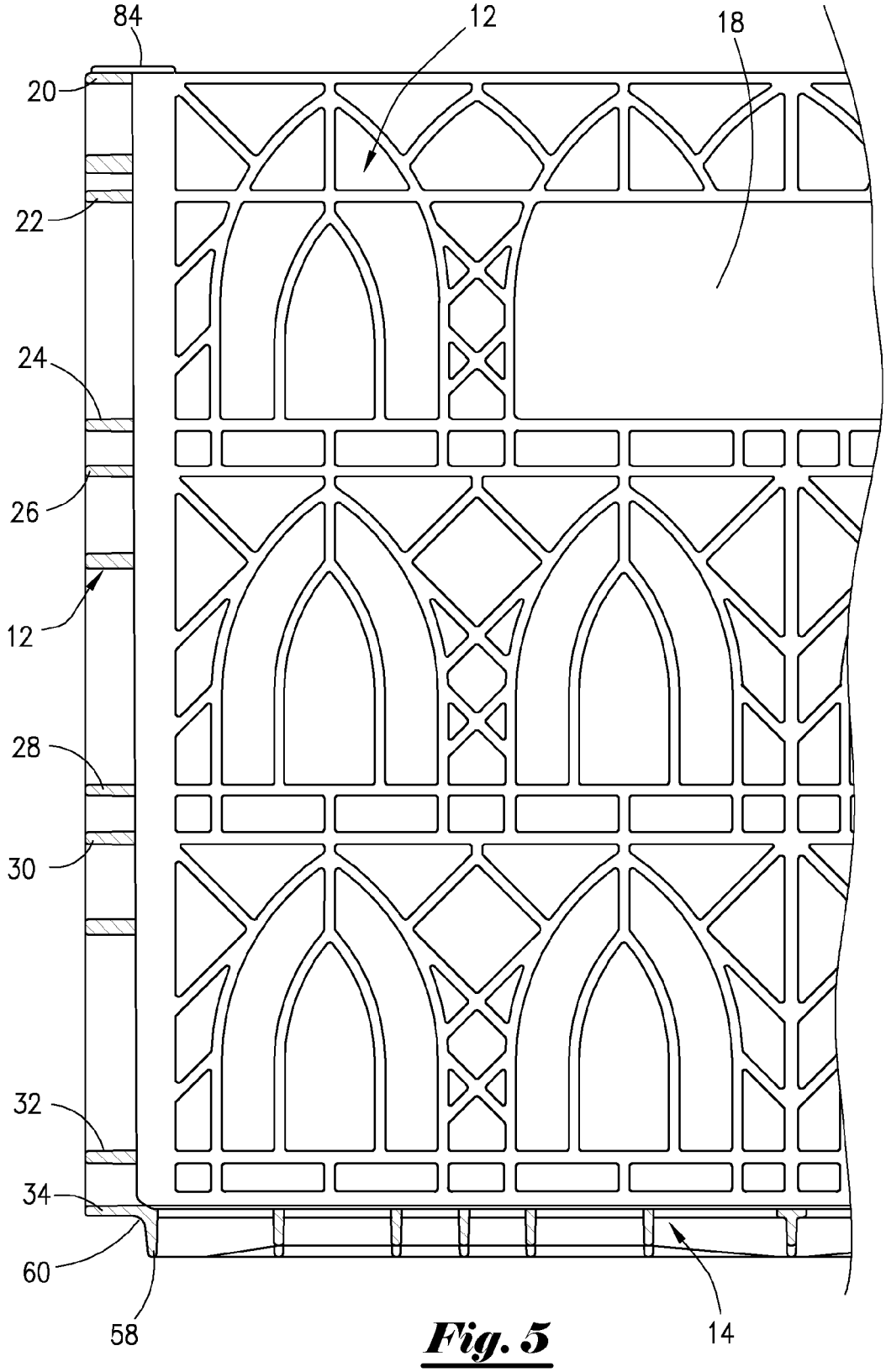
FIG. 5 is a partial cross-sectional view taken along lines A-A of FIG. 3.

FIG. 5 shows that bottom plate 14 is concave so that when in stacked arrangement and with a full load of contents, bottom plate 14 will not deform in an outwardly direction to the point where the surface of bottom plate 14 will come into contact with the contents of the lower crate. Such contact is not desired because it may degrade the containers housed in the lower crate or abrade the packaging to such an extent that manufacture identification and other markings may be removed or become unidentifiable.

Figure 6:
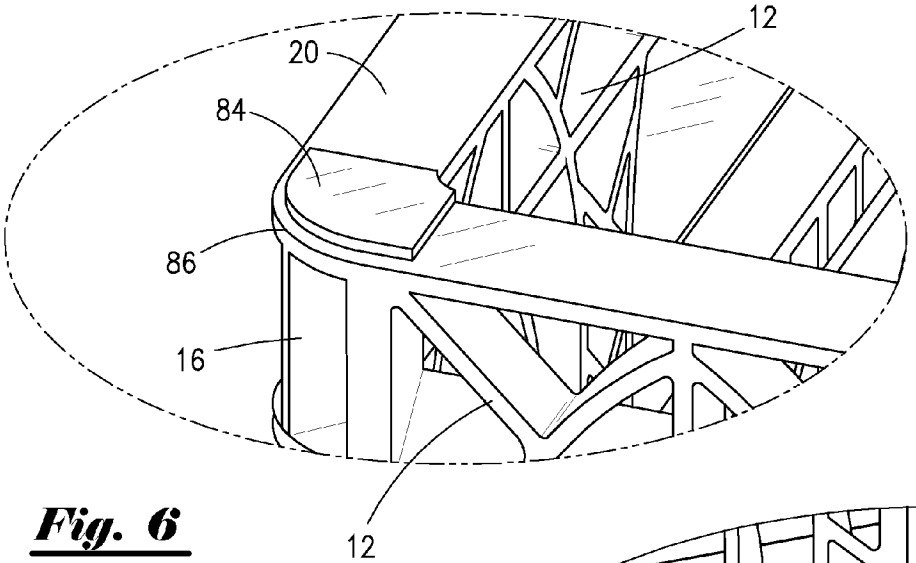
FIG. 6 is a partial isometric top view of the crate of the present invention showing an upper bearing pad.

FIG. 6 shows the positioning of upper load pads 84 in corner 86 of crate 10. Pads 86 may be integrally formed with column 16. Pads 84 may be variable in configuration and size so long as they are capable of directing load forces through columns 16 (to bottom plate 14) and away from the handle area of crate 10. Pads 84 function by providing the contact point between crate 10 and an upper crate stacked on crate 10. Pads 84 bear the load forces created by the weight of the upper crate and any additional crates stacked thereon, including the weight of the contents of the crate or crates. Pads 84 distribute the forces through columns 16 (to bottom plate 14) and away from the central areas of side walls 12 particularly away from the handle area surrounding opening 18. Crate 10 is able to bear load forces in excess of conventional beverage crates while being lighter in weight as a result of less material being used to form crate 10.

Figure 7:
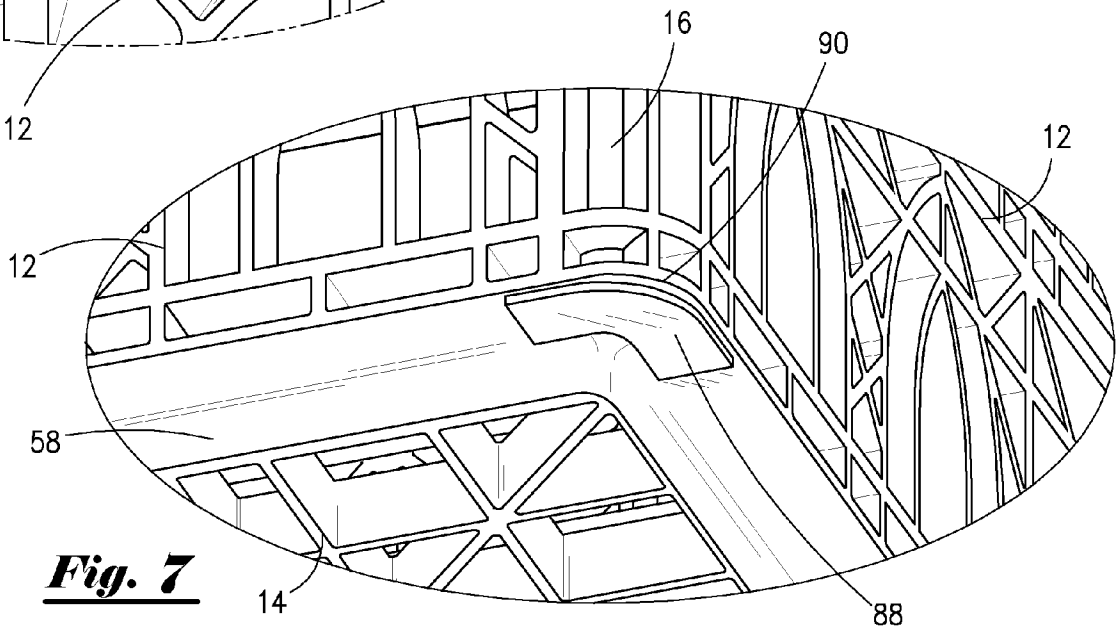
FIG. 7 is partial isometric bottom view of the crate of the present invention showing two lower bearing pads.

FIG. 7 reveals that bottom pads 88 may be placed or formed in bottom corners 90 of columns 16. Pads 88 are designed to mate with pads 84 when crate 10 is in stacking arrangement with a second crate 10 or with a conventional crate. Pads 88 further serve to distribute stacking loads through columns 16 and away from the central areas of crate 10, particularly the area surrounding the opening 18. Pads 88 may be variable in configuration and size so long as they are capable of directing load forces away from the central areas of side walls 12.

Figure 8:
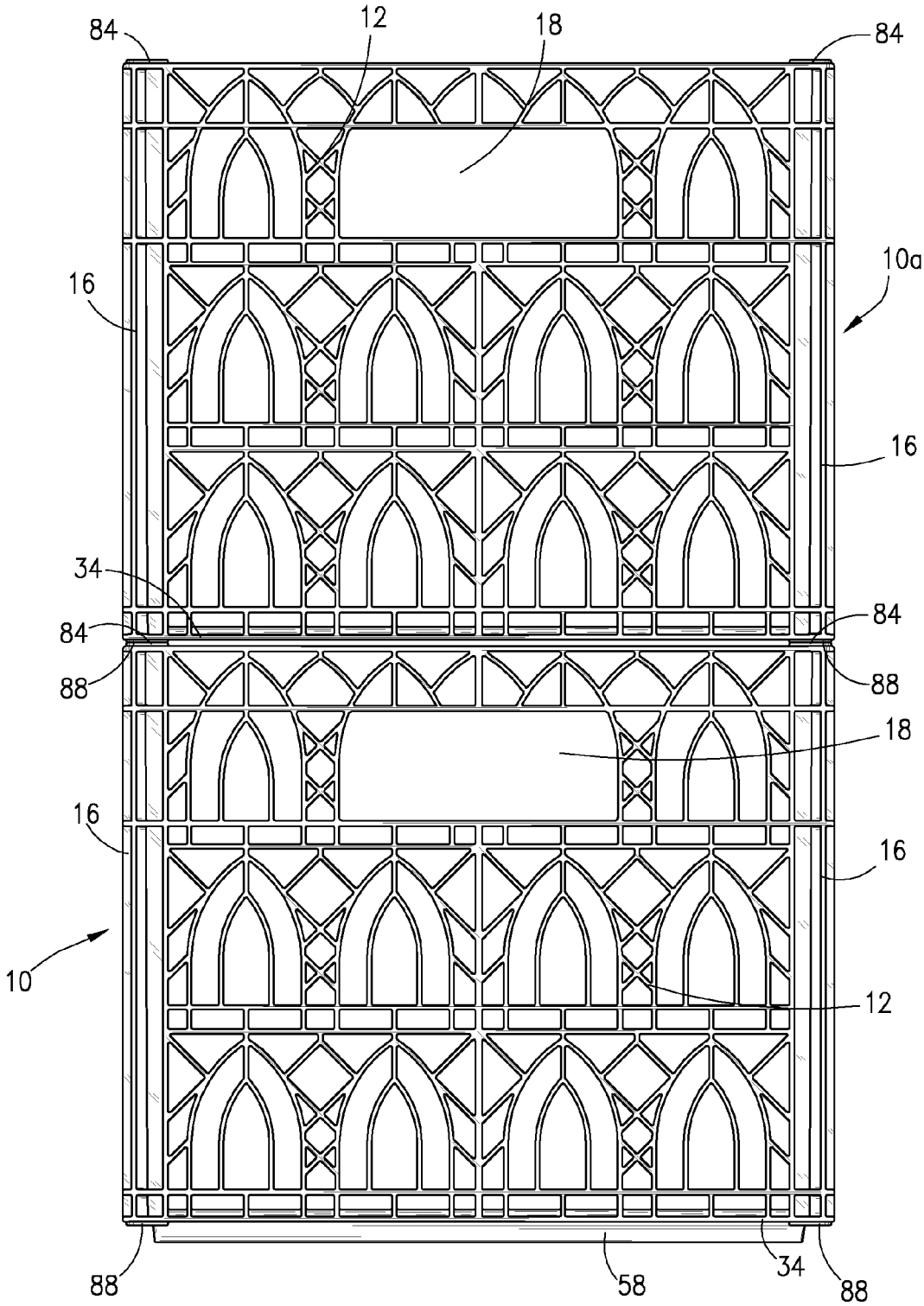
FIG. 8 is a side view of two stacked crates of the present invention.

FIG. 8 shows crates 10 in stacking arrangement. Pads 84 provide the contact point between crate 10 and upper crate 10*a* stacked on crate 10. Pads 84 bear the load forces created by the weight of upper crate 10*a* and any additional crates stacked thereon, including the weight of the contents of crate 10*a* and other stacked crates. Pads 84 distribute the forces through columns 16 (to bottom plate 14) and away from the central areas of side walls 12 particularly away from the handle area surrounding opening 18.

Crate 10 provides increased air circulation within area 92 (shown in FIG. 1) where contents are stored for transport. The increased air circulation results from less material being used to form side walls 12 and bottom plate 14. With less material, crate 10 has a greater unobstructed surface area that enables more air to circulate from outside the crate to within area 92 and around the contents of crate 10. Increased air circulation is important particularly for refrigerated contents housed within crate 10 such as milk. The contents are able to be kept at a more consistent temperature to thereby provide longer shelf life.

Crate 10 weighs between 1½ lbs. to 2 lbs. The lighter weight (as compared to conventional crates weighing 2½ lbs. to 3 lbs.) is the result of less material being used in the formation of crate 10. For example, less material is needed as a result of the arch patterns of side walls 12 and the pattern of bottom plate 14. While less material is used, crate 10 exhibits superior stability and strength. Because crate 10 weighs less than conventional beverage crates, crate 10 is easier to manipulate by persons transporting the contents of crate 10. In stacked arrangement, crates 10 are more easily hauled on and off a transport truck by delivery personnel using a hand-truck. Less effort and assertion is required to physically lift and move individual crates 10. Crates 10 also achieve fuel savings. Because they weigh less, crates 10 when stacked and transported in a delivery vehicle cause the vehicle to weigh less than if loaded with conventional crates. Less fuel is used to transport crates 10 and their contents due to the lighter weight of the load.

Crate 10 is also capable of bearing torque or perimeter loads in excess of those loads commonly generated when transporting conventional beverage crates. Crate 10 is also able to withstand impact forces that would be generated if crate 10 were dropped from a height of 30 inches with a standard content.

Crates 10 are also interchangeable with conventional beverage crates. Accordingly, crate 10 may be stacked onto a conventional beverage crate or receive a conventional beverage crate in stacked arrangement.

The structural stability and strength of crate 10 is the result of the symmetry of the support structures forming crate 10, particularly the arch patterns.

While preferred embodiments of the present invention have been described, it is to be understood that the embodiments described are illustrative only and that the scope of the invention is to be defined solely by the appended claims when accorded a full range of equivalents, many variations and modifications naturally occurring to those skilled in the art from a perusal hereof.

I claim:

1. A stackable crate comprising:

a bottom plate;

four side walls adjacent to said bottom plate forming an interior space for placement of objects, each side wall comprising: a pattern of outer arches and inner arches interconnected by a plurality of lateral beams wherein each of said inner and outer arches comprises two sides extending downward from an apex to two bottom points and wherein each of said inner arches is concentrically disposed within one of said outer arches, a plurality of vertical support beams, and a plurality of cross-beams, one of said lateral beams defining an upper edge of said side wall and another of said lateral beams defining a lower edge of said side wall wherein each of said side walls comprises a handle recess for placement of a hand and wherein each of said side walls comprises:

an upper central vertical beam extending from said upper edge to a top edge of said handle recess, a lower central vertical beam extending from a bottom edge of said handle recess to said lower edge of said side wall;

two or more lateral rows of said outer arches and said inner arches, said plurality of cross-beams interconnecting said outer arches with other outer arches, said upper and lower central vertical beams, each of said columns adjacent to said side wall, and said lateral beams;

wherein one of said lateral beams defines a top of each lateral row and another of said lateral beams defines a bottom of each lateral row; wherein another of said lateral beams extends through each of said lateral rows interconnecting with said two bottom points of each of said inner arches in the lateral row; and wherein each of said vertical support beams interconnects one or more of said lateral beams, the apex of one of said outer arches, and the apex of one of said inner arches; and four vertically extending columns interconnecting said four side walls and said bottom plate, each column having an upper end and a lower end, wherein said upper end of said column extends above said upper edge of each of said side walls and said lower end of said column extends below said lower edge of each of said side walls, said upper and lower ends capable of distributing a load force.

* * * * *